US011745178B2

(12) United States Patent
Wegener

(10) Patent No.: US 11,745,178 B2
(45) Date of Patent: Sep. 5, 2023

(54) FLUID PROCESSING CASSETTES INCORPORATING MICRO- AND MACROFLUIDIC CHANNELS

(71) Applicant: Fenwal, Inc., Lake Zurich, IL (US)

(72) Inventor: Christopher J. Wegener, Libertyville, IL (US)

(73) Assignee: Fenwal, Inc., Lake Zurich, IL (US)

( * ) Notice: Subject to any disclaimer, the term of this patent is extended or adjusted under 35 U.S.C. 154(b) by 264 days.

(21) Appl. No.: 16/713,071

(22) Filed: Dec. 13, 2019

(65) Prior Publication Data

US 2020/0188915 A1 Jun. 18, 2020

Related U.S. Application Data

(60) Provisional application No. 62/780,626, filed on Dec. 17, 2018.

(51) Int. Cl.
*B01L 3/00* (2006.01)

(52) U.S. Cl.
CPC ... *B01L 3/502715* (2013.01); *B01L 2300/041* (2013.01); *B01L 2300/06* (2013.01); *B01L 2300/0848* (2013.01); *B01L 2300/123* (2013.01); *B01L 2400/0475* (2013.01); *B01L 2400/06* (2013.01)

(58) Field of Classification Search
CPC .. B01L 3/502715; B01L 3/5027; B01L 3/502; B01L 3/50; B01L 2300/041; B01L 2300/06; B01L 2300/0848; B01L 2300/123; B01L 2400/0475; B01L 2400/06
USPC ..... 422/505, 500, 50
See application file for complete search history.

(56) References Cited

U.S. PATENT DOCUMENTS

| | | | |
|---|---|---|---|
| 4,798,090 | A | 1/1989 | Heath et al. |
| 5,868,696 | A | 2/1999 | Floden |
| 8,758,288 | B2 | 6/2014 | Manzella, Jr. et al. |
| 10,413,653 | B2 | 9/2019 | Case et al. |

(Continued)

FOREIGN PATENT DOCUMENTS

| | | | |
|---|---|---|---|
| WO | WO 99/11035 | A1 | 3/1999 |
| WO | WO 2014/099779 | A1 | 6/2014 |
| WO | WO 2018/158273 | A1 | 9/2018 |

OTHER PUBLICATIONS

Extended European Search Report for Application No. 19215883.0 dated Apr. 23, 2020.

*Primary Examiner* — Christine T Mui
(74) *Attorney, Agent, or Firm* — Cook Alex Ltd.

(57) ABSTRACT

A fluid processing cassette includes first and second covers, with an interior wall positioned between the covers. The interior wall includes a first surface facing the first cover and defining a portion of a plurality of macrofluidic channels. A second surface of the interior wall faces the second cover and defines a portion of a plurality of microfluidic channels. At least one opening defined in the interior wall provides fluid communication between at least one of the macrofluidic channels and at least one of the microfluidic channels. An additional interior wall may also be positioned between the covers, with each interior wall secured to a different one of the covers and to the other interior wall. The additional interior wall may be positioned between the first cover and the interior wall, with macrofluidic channels defined on each side of the additional interior wall.

21 Claims, 3 Drawing Sheets

(56) References Cited

U.S. PATENT DOCUMENTS

| | | | | |
|---|---|---|---|---|
| 2007/0125942 | A1* | 6/2007 | Kido | B01L 3/502715 250/284 |
| 2013/0042888 | A1 | 2/2013 | Zucchelli | |
| 2014/0322100 | A1* | 10/2014 | Laermer | B81C 3/005 53/410 |
| 2016/0051744 | A1 | 2/2016 | Abedin et al. | |
| 2018/0229239 | A1 | 8/2018 | Cauley et al. | |

* cited by examiner

FLUID PROCESSING CASSETTES INCORPORATING MICRO- AND MACROFLUIDIC CHANNELS

CROSS-REFERENCE TO RELATED APPLICATIONS

This application claims the benefit of and priority of U.S. Provisional Patent Application Ser. No. 62/780,626, filed Dec. 17, 2018, the contents of which are incorporated by reference herein.

BACKGROUND

Field of the Disclosure

The present subject matter relates to fluid processing cassettes and, more particularly, to fluid processing cassettes incorporating both micro- and macro-fluidic channels.

Description of Related Art

Microfluidic devise (or "chips") offer novel ways to use micron-sized features within a fluid path to achieve physical fluid flow conditions that are not possible using macro-sized features. One relevant use of microfluidic devices is for separation of blood or blood components. This can be achieved through varied approaches (e.g., using an electric or gravitational separation field), which often enable much more precise separation than can be achieved through traditional means, such as macro-scale centrifugation or filtration.

Two of the largest challenges to using microfluidics in the field of blood separation are low volumetric flow rate throughput and the limited ability to automate complex fluidic processes, as may be required to perform a procedure such as apheresis or cell washing. Current approaches to driving microfluidic systems rely on tubing interfacing directly to microfluidic chips. However, tubing-based macrofluidic control systems (especially for closed systems) are often comprised of tubing pinch valves and disposable syringes driven by one or more lead-screw syringe pumps, resulting in cumbersome systems with large footprints.

SUMMARY

There are several aspects of the present subject matter, which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a fluid processing cassette includes first and second covers, with an interior wall positioned between the first and second covers. The interior wall includes a first surface facing the first cover and defining a portion of a plurality of macrofluidic channels. The interior wall also includes a second surface facing the second cover and defining a portion of a plurality of microfluidic channels. The interior wall defines at least one opening providing fluid communication between at least one of the plurality of microfluidic channels and at least one of the macrofluidic channels.

In another aspect, a fluid processing cassette includes first and second covers, with a first interior wall secured to the first cover. A second interior wall is secured to the first interior wall and to the second cover. The first interior wall includes a first surface facing the first cover and cooperating with the first cover to define a plurality of macrofluidic channels. A second surface of the first interior wall faces the second interior wall. The second interior wall includes a first surface facing the first interior wall and cooperating with the second surface of the first interior wall to define a plurality of macrofluidic channels. A second surface of the second interior wall faces the second cover and cooperates with the second cover to define a plurality of microfluidic channels. The second interior wall defines at least one opening providing fluid communication between at least one of the plurality of microfluidic channels and at least one of the macrofluidic channels defined by the first and second interior walls.

In yet another aspect, a method of conveying a fluid into a microfluidic channel includes conveying a fluid into a macrofluidic channel defined in a fluid processing cassette. The fluid is conveyed from the macrofluidic channel, through an opening defined in an interior wall of the fluid processing cassette, and into a microfluidic channel defined in the fluid processing cassette.

DESCRIPTION OF THE ILLUSTRATED EMBODIMENTS

The embodiments disclosed herein are for the purpose of providing a description of the present subject matter, and it is understood that the subject matter may be embodied in various other forms and combinations not shown in detail. Therefore, specific designs and features disclosed herein are not to be interpreted as limiting the subject matter as defined in the accompanying claims.

Figure 1:
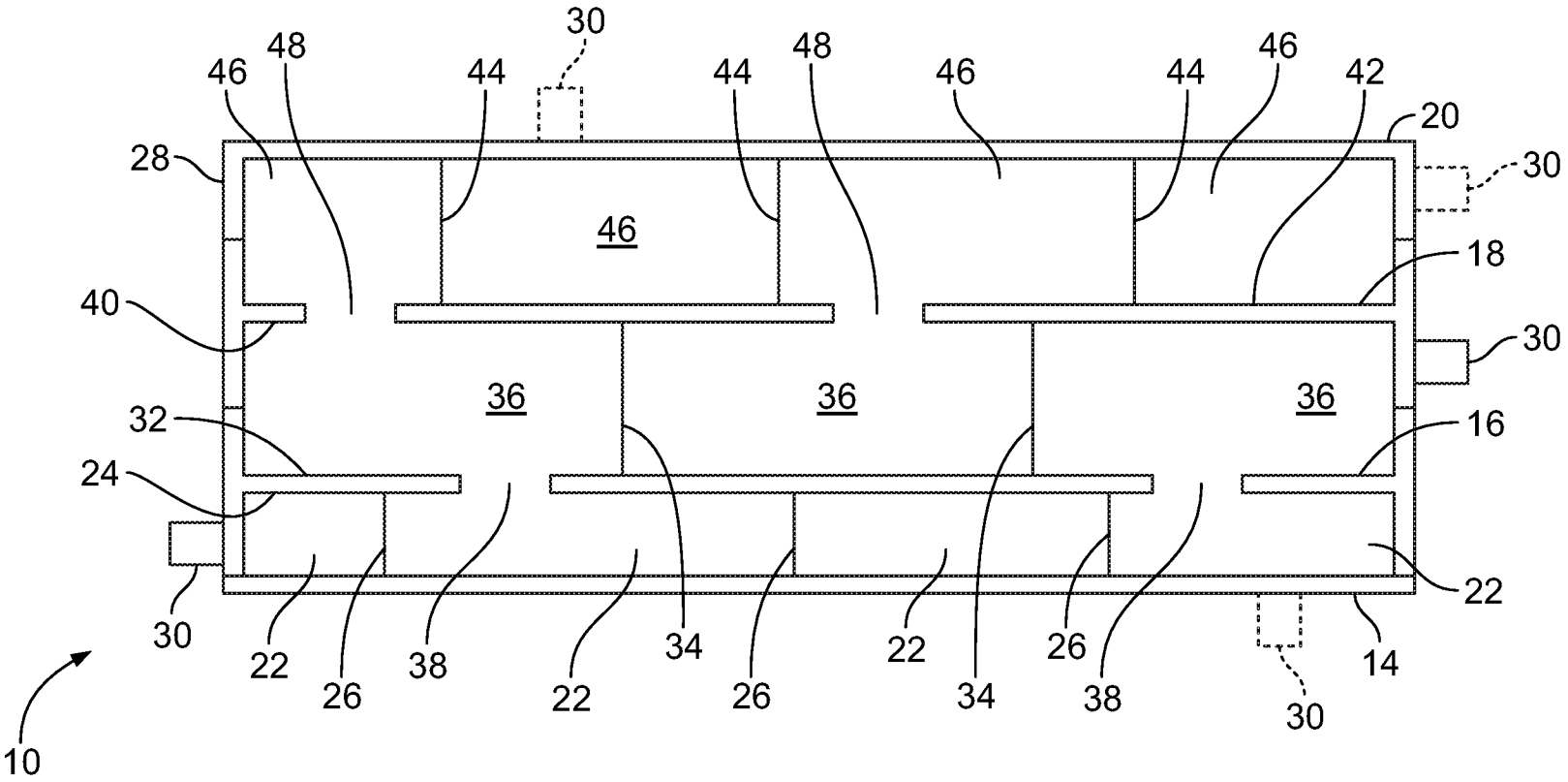
FIG. 1 is a cross-sectional end view of a fluid processing cassette according to an aspect of the present disclosure.
Figure 2:
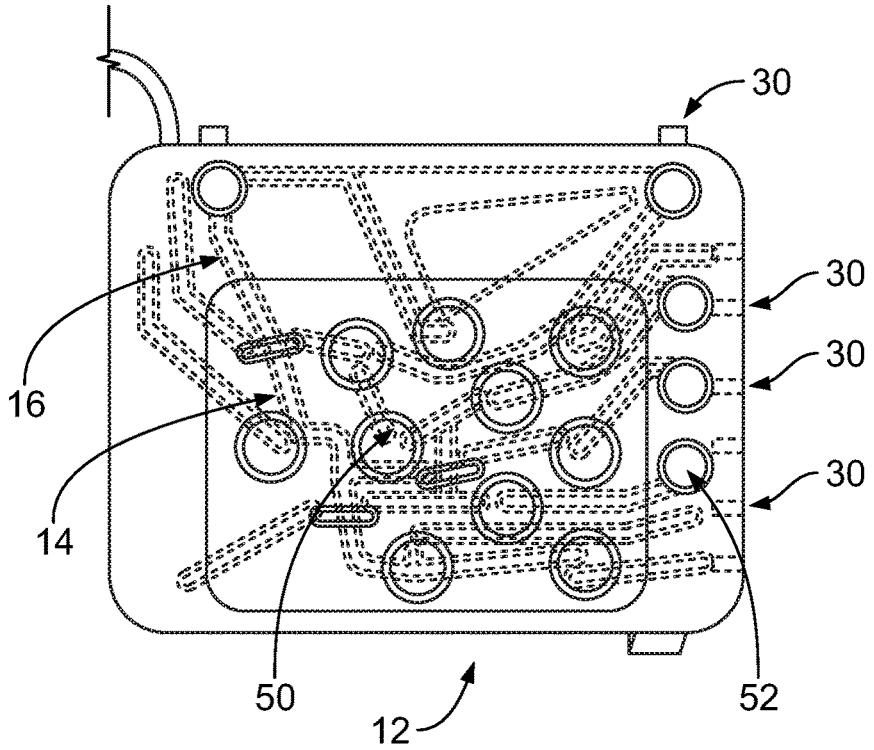
FIG. 2 (PRIOR ART)
FIG. 2 is a bottom plan view of a cassette according to conventional design.
Figure 3:
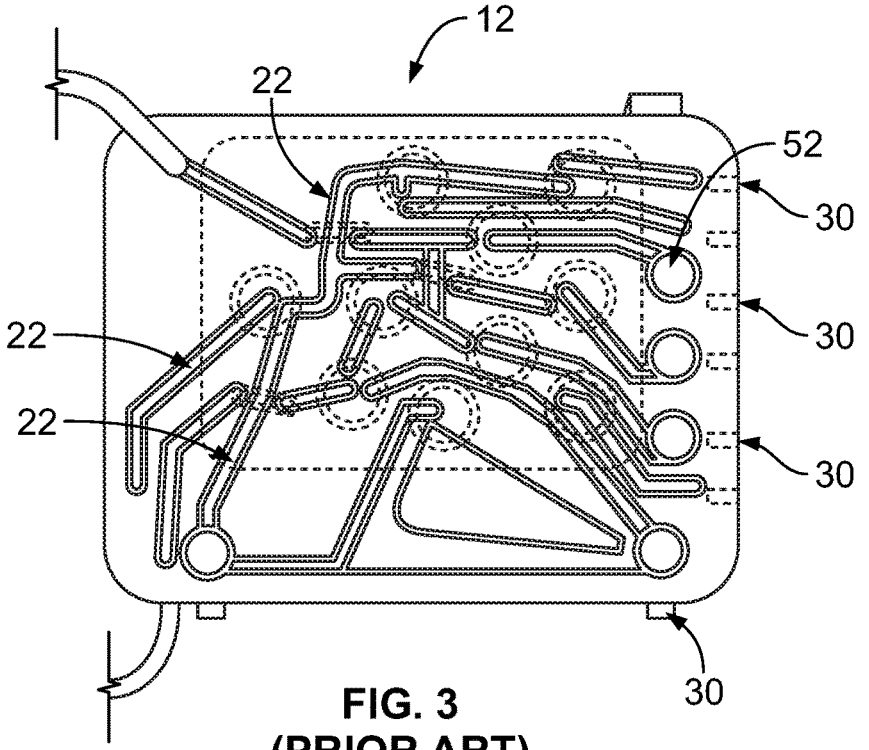
FIG. 3 (PRIOR ART)
FIG. 3 is a top plan view of the cassette of FIG. 2.
Figure 4:
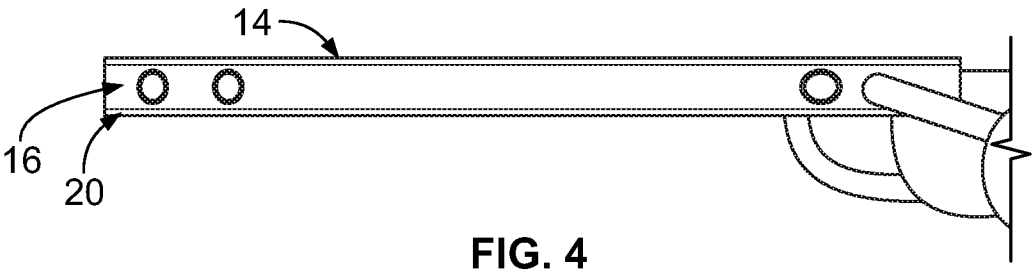
FIG. 4 (PRIOR ART)
FIG. 4 is an end view of the cassette of FIG. 2.

According to the present disclosure, a microfluidic device may be incorporated into a fluid processing cassette of the type conventionally used in combination with fluid (e.g., blood) processing or separation systems, such as centrifuges. As used herein, the term "cassette" refers to a component that includes a number of defined fluid channels, with some comprising fluid flow paths and others comprising valve stations for directing fluid flow through the various fluid flow paths. Fluid channels may also provide other functions, such as serving as sensing stations (to sense fluid pressure, optical or electrical properties, turbidity, etc.) or pump stations or filters. While fluid processing cassettes according to the present disclosure may have particular utility in blood separation systems, they are not limited to use in blood separation systems, but may be employed in other fluid processing systems, such as dialysis systems, intravenous administration systems, and others. FIG. 1 is a schematic cross-sectional view of such a cassette 10 according to the present disclosure, while FIGS. 2-4 show an exemplary cassette 12 that may form the basis of the modified cassette 10.

The fluid processing cassette 10 of FIG. 1 includes a first cover 14, a first interior wall 16, a second interior wall 18, and a second cover 20. The first cover 14 and the first interior wall 16 of the cassette 10 may be generally configured as in a conventional cassette 12 of the type shown in FIGS. 2-4. However, the conventional cassette 12 omits a second interior wall 18 of the type described herein, which provides microfluidic channels within the cassette 10, as will be described in greater detail herein.

More particularly, the first cover 14 is configured to be placed against a complementary surface of a fluid processing system that is configured to convey fluid into and through the cassette 10. Different fluid processing systems may be configured to convey fluid into and through an associated cassette in different manners. For example, certain fluid processing systems are configured to manipulate a flexible membrane or diaphragm of a cassette to convey fluid through the cassette, sense fluid pressure within the cassette, and/or to actuate valve stations of the cassette to direct fluid flow through the cassette. Accordingly, in order to be used in combination with such fluid processing systems, the first cover 14 may be formed of a generally flexible material, such as a flexible plastic material. In other fluid processing systems, the surface of the cassette facing the fluid processing system is rigid, with some other means being provided for conveying fluid through the cassette (e.g., with peristaltic pumps of the fluid processing system interacting with tubing loops extending from a sidewall of the cassette). Accordingly, in order to be used in combination with such fluid processing systems, the first cover 14 may instead be formed of a generally rigid material, such as a rigid plastic material.

The first interior wall 16, which is preferably formed of a generally rigid material (such as a rigid plastic material), is positioned adjacent to the first cover 14 and secured thereto. The first interior wall 16 may be secured to the first cover 14 by any suitable means, which may include an adhesive or a weld (e.g., a hot plate weld, a laser weld, or an ultrasonic weld). The first cover 14 and the first interior wall 16 cooperate to define a plurality of macrofluidic channels 22 configured for fluid flow therethrough, which may also include other functionality (e.g., valving, sensing, or pumping). The number and configuration of the macrofluidic channels 22 may vary without departing from the scope of the present disclosure. FIG. 1 shows a simplified version of the macrofluidic channels 22, while FIG. 3 shows macrofluidic channels 22 having configurations that are more consistent with the macrofluidic channels 22 that a cassette 10 according to the present disclosure may be preferred to have.

In one embodiment, the surface of the first cover 14 facing the first interior wall 16 is substantially planar, with a first surface 24 of the first interior wall 16 including a plurality of projections 26 extending toward the first cover 14. In such a configuration, the first interior wall 16 provides an end (i.e., the first surface 24) and a sidewall (i.e., the projections 26) of each macrofluidic channel 22, with the first cover 14 being secured to the projections 26 to provide a second end that closes each macrofluidic channel 22. The perimeter of the first interior wall 16 may include a projection extending toward the first cover 14 to define a portion of a sidewall 28 of the cassette 10. The sidewall 28 may include a plurality of ports 30 (as in FIGS. 2 and 3) each configured to accommodate a conduit (e.g., flexible tubing) for conveying fluid into and/or out of the cassette 10. In certain embodiments, at least one such port 30 may be also (or alternatively) incorporated into the first cover 14 for conveying fluid into and/or out of the cassette 10 (shown in broken lines in FIG. 1).

The opposing, second surface 32 of the first interior wall 16 may also include a plurality of projections 34. The projections 34 of the second surface 32 define portions of additional macrofluidic channels 36, with one projection extending along the perimeter of the second surface 32 defining a portion of the sidewall 28 of the cassette 10. In order to allow for fluid communication between macrofluidic channels 22 and 36 associated with opposite surfaces of the first interior wall 16, at least one opening 38 may be defined by the first interior wall 16, with each opening 38 providing a fluid path between a macrofluidic channel 22 of the first surface 24 and a macrofluidic channel 36 of the second surface 32.

The second interior wall 18, which is preferably formed of a generally rigid material (such as a rigid plastic material), is positioned between the first interior wall 16 and the second cover 20 and secured to each. The second interior wall 18 may be secured to the first interior wall 16 and the second cover 20 by any suitable means, which may include an adhesive or a weld (e.g., a hot plate weld, a laser weld, or an ultrasonic weld). As described above, the first and second interior walls 16 and 18 cooperate to define a plurality of macrofluidic channels 36 configured for fluid flow therethrough, which may also include other functionality. The number and configuration of the macrofluidic channels 36 may vary without departing from the scope of the present disclosure, but it may be advantageous for the macrofluidic channels 36 to be configured as in FIG. 3. The second surface 32 of the first interior wall 16 and a first surface 40 of the second interior wall 18 may each include projections 34 that are secured together to define the sidewalls of the macrofluidic channels 36. Alternatively, it is within the scope of the present disclosure for only one of the second surface 32 of the first interior wall 16 and the first surface 40 of the second interior wall 18 to include channel-defining projections 34, while the other surface is substantially planar, providing only an end of the macrofluidic channels 36. Projections extending along the perimeters of the second surface 32 of the first interior wall 16 and/or the first surface 40 of the second interior wall 18 define a portion of the sidewall 28 of the cassette 10. The portion of the sidewall 28 positioned between the first and second interior walls 16 and 18 may include at least one port 30 configured to accommodate a conduit for conveying fluid into and/or out of the cassette 10.

The opposing, second surface 42 of the second interior wall 18 may also include a plurality of projections 44. The projections 44 of the second surface 42 define portions of microfluidic channels 46, with one projection extending along the perimeter of the second surface 42 defining a portion of the sidewall 28 of the cassette 10. The projections 44 of the second surface 42 are sealed against the second cover 20 to define sidewalls of each microfluidic channel 46, with the second interior wall 18 and the second cover 20 defining opposing ends of each microfluidic channel 46. Alternatively, the sidewalls of the microfluidic channels 46 may be partially or entirely defined by projections 44 extending from the surface of the second cover 20 facing the second interior wall 18. The microfluidic channels 46 may be formed by any suitable approach, which may include injection-molding or hot-embossing, for example.

The number and configuration of the microfluidic channels 46 may vary without departing from the scope of the present disclosure. For example, selected microfluidic channels 46 may be configured as valve stations to direct flow through the microfluidic channels 46, while other microfluidic channels 46 are configured for fluid separation or analyzation. In order to allow for fluid communication between the macrofluidic channels 36 associated with the first surface 40 of the second interior wall 18 and the microfluidic channels 46 associated with the second surface 42, at least one opening 48 may be defined by the second interior wall 18, with each opening 48 providing a fluid path between a macrofluidic channel 36 of the first surface 40 and a microfluidic channel 46 of the second surface 42.

The cassette 10 is incorporated into a single use, sterile processing set, with conduits connecting the ports 30 of the cassette 10 to other components of the set or to other ports 30 of the cassette 10. The configuration of the single use processing sets used in combination with different fluid processing systems varies widely, but most sets will typically include a plurality of bags for holding a fluid, fluid component, or additive fluid and, in the case of a set used in combination with a blood processing system, devices for drawing fluid from a source and for returning processed fluid or a fluid component to the source (e.g. a phlebotomy needle). A set may include additional or alternative components (e.g., fluid filters, drip chambers, and separation assemblies) without departing from the scope of the present disclosure.

In use, the cassette 10 is secured to a cassette holder of an associated fluid processing system, with the first cover 14 facing the fluid processing system and the second cover 20 facing away from the fluid processing system. Any valve actuators of the cassette holder are aligned with valve stations of the cassette 10, with any sensors and pump actuators of the cassette holder being aligned with sensing stations and pump stations of the cassette 10, if provided. FIG. 2 shows selected fluid channels configured as valve stations 50 and others configured as sensing stations 52, which configurations selected macrofluidic channels 22 of the cassette 10 may assume.

An exemplary cassette holder is described in greater detail in U.S. Pat. No. 5,868,696, which is hereby incorporated herein by reference and which also describes a cassette having a first cover and first interior wall of the type that may be employed in cassettes according to the present disclosure. It should be understood that the cassette holder and associated cassette described in U.S. Pat. No. 5,868,696 are merely exemplary and that cassettes according to the present disclosure may be differently configured to cooperate with differently configured cassette holders.

The fluid processing system conveys fluid into one of the macrofluidic channels 22, 36 and may actuate one or more of the valve stations 50 to direct fluid flow through the cassette 10. This may include conveying fluid exclusively through the macrofluidic channels 22 and 36 or directing fluid from the macrofluidic channels 22, 36 to the microfluidic channels 46, with at least a portion of the fluid ultimately being returned from the microfluidic channels 46 to the macrofluidic channels 22, 366 and exiting the cassette 10. As described above, at least one of the microfluidic channels 46 may be configured to separate a fluid (e.g., blood) into two or more fluid components (e.g., based on the size and/or deformability of different blood cells) using any of a number of suitable techniques (e.g., an electric or gravitational or centrifugal or magnetic or acoustic separation field), such that a fluid may be conveyed into the microfluidic channels 46 from the macrofluidic channels 22, 36, followed by separated fluid components being returned from the microfluidic channels 46 to the macrofluidic channels 22, 36. Alternatively, the second cover 20 and/or the portion of the cassette sidewall 28 positioned between the second interior wall 18 and the second cover 20 may be provided with a port 30 configured to accommodate a conduit (as shown in broken lines in FIG. 1), with fluid or a fluid component being directly conveyed out of the cassette 10 from a microfluidic channel 46 (via the port 30), rather than passing through a macrofluidic channel 22, 36 before exiting the cassette 10.

Figure 5:
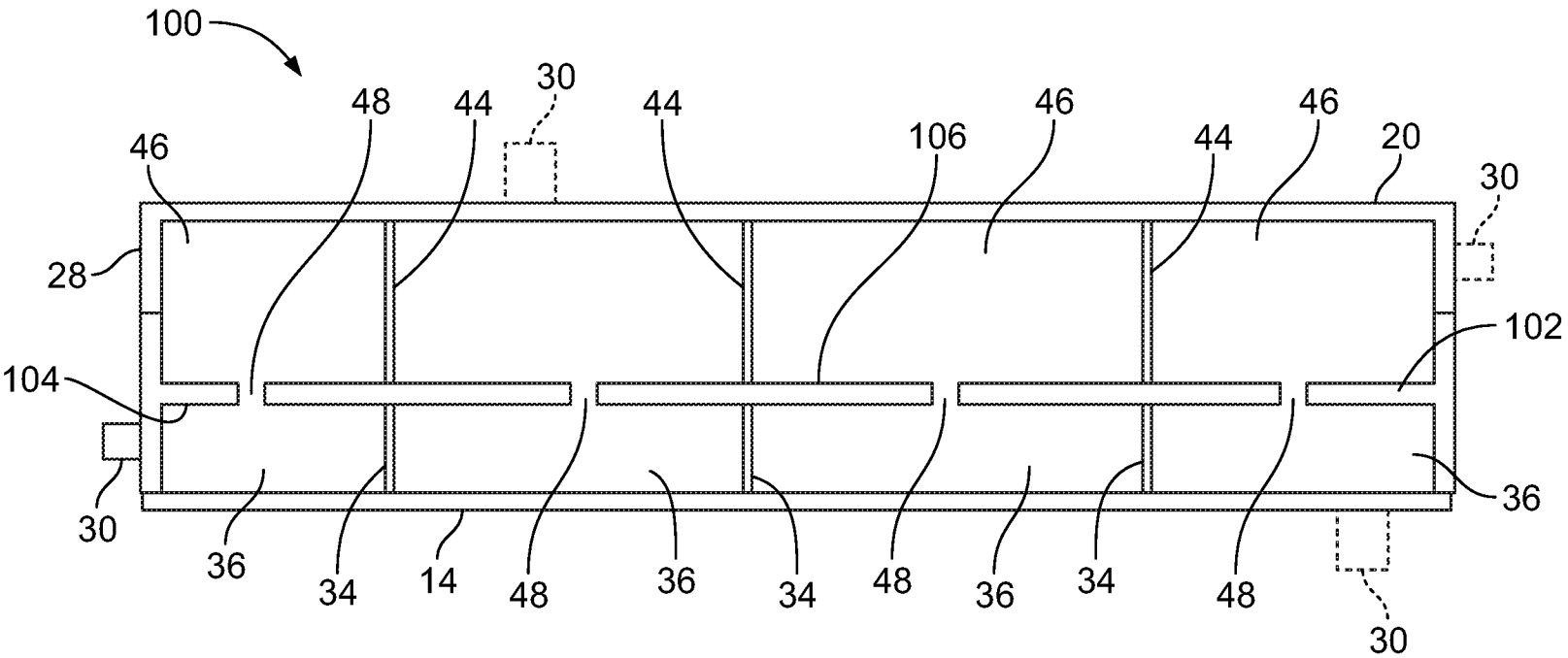
FIG. 5 is a cross-sectional end view of another embodiment of a fluid processing cassette according to an aspect of the present disclosure.

FIG. 5 shows a variation of the cassette 10 of FIG. 1. In the embodiment of FIG. 5, the cassette 100 includes only one interior wall 102, rather than a pair of interior walls. The interior wall 102 is secured to the first and second covers 14 and 20 of the cassette 100, with a first surface 104 of the interior wall 102 facing the first cover 14 and an opposing second surface 106 of the interior wall 102 facing the second cover 20. The first surface 104 of the interior wall 102 cooperates with the first cover 14 to define a plurality of macrofluidic channels 36, while the second surface 106 of the interior wall 102 cooperates with the second cover 20 to define a plurality of microfluidic channels 46. The interior wall 102 may, thus, be understood as being structurally similar to the second interior wall 18 of the cassette 10 of FIG. 1, in that it provides a transition between microfluidic channels 46 and macrofluidic channels 36 within the body of the cassette. Other than this difference, it should be understood that the cassette 100 of FIG. 5 and its individual components are structurally and functionally similar to the cassette 10 and corresponding components of FIG. 1 and that the structure and function of the cassette 100 and its individual components may be understood with reference to the preceding description of the cassette 10.

Indeed, the principal difference between the cassettes 10 and 100 is that, in the cassette 100, there is only one layer of macrofluidic channels, rather than two layers of macrofluidic channels (as in the cassette 10 of FIG. 1). Multiple layers of macrofluidic channels may enable a greater number of microfluidic channels than a single layer of macrofluidic channels for a given cassette footprint, which is limited by the fluid processing system to which the cassette is to be coupled. Other considerations (e.g., the complexity of the layout of the macrofluidic and/or microfluidic channels of the cassette) may also necessitate the use of a cassette having a plurality of layers of macrofluidic channels. On the other hand, if a relatively large number of microfluidic channels is not required and if the layouts of the macrofluidic and microfluidic channels are not particularly complex, then a simplified cassette having only a single layer of macrofluidic channels (as in FIG. 5) will suffice.

Aspects

Aspect 1. A fluid processing cassette comprising: first and second covers; and an interior wall positioned between the first and second covers, wherein the interior wall includes a first surface facing the first cover and defining a portion of a plurality of macrofluidic channels, and a second surface facing the second cover and defining a portion of a plurality of microfluidic channels, and the interior wall defines at least one opening providing fluid communication between at least one of the plurality of microfluidic channels and at least one of the macrofluidic channels.

Aspect 2. The fluid processing cassette of Aspect 1, wherein the first cover is generally flexible.

Aspect 3. The fluid processing cassette of Aspect 1, wherein the first cover is generally rigid.

Aspect 4. The fluid processing cassette of any one of the preceding Aspects, wherein at least one of the macrofluidic channels comprises a sensing station.

Aspect 5. The fluid processing cassette of any one of the preceding Aspects, wherein at least one of the macrofluidic channels comprises a valve station.

Aspect 6. The fluid processing cassette of any one of the preceding Aspects, wherein at least one of the macrofluidic channels comprises a pump station.

Aspect 7. The fluid processing cassette of any one of the preceding Aspects, wherein the interior wall is secured to one of the covers by an adhesive.

Aspect 8. The fluid processing cassette of any one of Aspects 1-6, wherein the interior wall is secured to one of the covers by a weld.

Aspect 9. The fluid processing cassette of Aspect 8, wherein the weld comprises a hot plate weld.

Aspect 10. The fluid processing cassette of Aspect 8, wherein the weld comprises a laser weld.

Aspect 11. The fluid processing cassette of Aspect 8, wherein the weld comprises an ultrasonic weld.

Aspect 12. The fluid processing cassette of any one of the preceding Aspects, wherein the second cover defines one end and a sidewall of each microfluidic channel, and the second surface of the interior wall defines a second end of each microfluidic channel.

Aspect 13. The fluid processing cassette of any one of the preceding Aspects, wherein the first cover is configured to be placed against a complementary surface of a fluid processing system configured to convey fluid into and through the fluid processing cassette.

Aspect 14. The fluid processing cassette of any one of the preceding Aspects, wherein at least one of the covers includes a port configured to accommodate a conduit for conveying fluid into and/or out of the fluid processing cassette.

Aspect 15. The fluid processing cassette of any one of the preceding Aspects, wherein at least one of the microfluidic channels is configured to separate a fluid into two or more fluid components.

Aspect 16. The fluid processing cassette of any one of the preceding Aspects, further comprising an additional interior wall, wherein the additional interior wall is secured to the first cover, the interior wall is secured to the additional interior wall and to the second cover, a first surface of the additional interior wall faces the first cover and cooperates with the first cover to define a plurality of macrofluidic channels, a second surface of the additional interior wall faces the interior wall and cooperates with the first surface of the interior wall to define a plurality of macrofluidic channels, and the second surface of the interior wall cooperates with the second cover to define said plurality of microfluidic channels.

Aspect 17. A fluid processing cassette comprising: first and second covers; a first interior wall secured to the first cover; and a second interior wall secured to the first interior wall and to the second cover, wherein the first interior wall includes a first surface facing the first cover and cooperating with the first cover to define a plurality of macrofluidic channels, and a second surface facing the second interior wall, and the second interior wall includes a first surface facing the first interior wall and cooperating with the second surface of the first interior wall to define a plurality of macrofluidic channels, a second surface facing the second cover and cooperating with the second cover to define a plurality of microfluidic channels, and the second interior wall defines at least one opening providing fluid communication between at least one of the plurality of microfluidic channels and at least one of the macrofluidic channels defined by the first and second interior walls.

Aspect 18. The fluid processing cassette of Aspect 17, wherein at least one of the interior walls is secured to the associated cover and/or to the other interior wall by an adhesive.

Aspect 19. The fluid processing cassette of Aspect 17, wherein at least one of the interior walls is secured to the associated cover and/or to the other interior wall by an weld.

Aspect 20. The fluid processing cassette of any one of Aspects 17-19, wherein the second surface of the first interior wall defines one end and a sidewall of each macrofluidic channel defined between the interior walls, and the first surface of the second interior wall defines a second end of each macrofluidic channel defined between the interior walls.

Aspect 21. A method of conveying a fluid into a microfluidic channel, comprising: conveying a fluid into a macrofluidic channel defined in a fluid processing cassette; and conveying the fluid from the macrofluidic channel, through an opening defined in an interior wall of the fluid processing cassette, and into a microfluidic channel defined in the fluid processing cassette.

Aspect 22. The method of Aspect 21, further comprising separating the fluid into two or more fluid components after conveying the fluid into the microfluidic channel.

Aspect 23. The method of any one of Aspects 21-22, further comprising conveying at least a portion of the fluid from the microfluidic channel through a second opening defined in the interior wall of the fluid processing cassette and into a second macrofluidic channel defined in the fluid processing cassette.

Aspect 24. The method of Aspect 23, further comprising conveying said at least a portion of the fluid out of the fluid processing cassette after flowing said at least a portion of the fluid into the second macrofluidic channel.

It will be understood that the embodiments and examples described above are illustrative of some of the applications of the principles of the present subject matter. Numerous modifications may be made by those skilled in the art without departing from the spirit and scope of the claimed subject matter, including those combinations of features that are individually disclosed or claimed herein. For these reasons, the scope hereof is not limited to the above description but is as set forth in the following claims, and it is understood that claims may be directed to the features hereof, including as combinations of features that are individually disclosed or claimed herein.

The invention claimed is:

1. A fluid processing cassette comprising:

first and second covers; and an interior wall positioned between the first and second covers, wherein the interior wall includes a first surface facing a substantially planar surface of the first cover and defining a portion of a plurality of macrofluidic channels, and a second surface facing the second cover and defining a portion of a plurality of microfluidic channels, with at least one of the microfluidic channels being configured to separate a fluid into two or more fluid components and including a first outlet port for at least a portion of a first separated fluid component and a second outlet port for at least a portion of a second separated fluid component fluid component, the interior wall defines at least one opening providing fluid communication between at least one of the plurality of microfluidic channels and at least one of the macrofluidic channels, and side walls of the microfluidic channels are at least partially defined by projections extending from a surface of the second cover facing the second surface of the interior wall.

2. The fluid processing cassette of claim 1, wherein the first cover is flexible.

3. The fluid processing cassette of claim 1, wherein the first cover is rigid.

4. The fluid processing cassette of claim 1, wherein the interior wall is secured to one of the covers by an adhesive.

5. The fluid processing cassette of claim 1, wherein the interior wall is secured to one of the covers by a weld.

6. The fluid processing cassette of claim 5, wherein the weld comprises a hot plate weld.

7. The fluid processing cassette of claim 5, wherein the weld comprises a laser weld.

8. The fluid processing cassette of claim 5, wherein the weld comprises an ultrasonic weld.

9. The fluid processing cassette of claim 1, wherein the second cover defines one end and the projections extending from the second cover entirely define the sidewalls of each microfluidic channel, and the second surface of the interior wall defines a second end of each microfluidic channel.

10. The fluid processing cassette of claim 1, wherein the first cover is configured to be placed against a complementary surface of a fluid processing system configured to convey fluid into and through the fluid processing cassette.

11. The fluid processing cassette of claim 1, wherein at least one of the covers includes a port configured to accommodate a conduit for conveying fluid into and/or out of the fluid processing cassette.

12. The fluid processing cassette of claim 1, further comprising an additional interior wall, wherein the additional interior wall is secured to the first cover, the interior wall is secured to the additional interior wall and to the second cover, a first surface of the additional interior wall faces the first cover and cooperates with the first cover to define a plurality of macrofluidic channels, a second surface of the additional interior wall faces the interior wall and cooperates with the first surface of the interior wall to define a plurality of macrofluidic channels, and the second surface of the interior wall cooperates with the second cover to define said plurality of microfluidic channels.

13. A fluid processing cassette comprising:

first and second covers;

a first interior wall secured to the first cover; and a second interior wall secured to the first interior wall and to the second cover, wherein the first interior wall includes a first surface facing a substantially planar surface of the first cover and cooperating with the first cover to define a plurality of macrofluidic channels, and a second surface facing the second interior wall, the second interior wall includes a first surface facing the first interior wall and cooperating with the second surface of the first interior wall to define a plurality of macrofluidic channels, a second surface facing a surface of the second cover and cooperating with the second cover to define a plurality of microfluidic channels, with at least one of the microfluidic channels being configured to separate a fluid into two or more fluid components and including a first outlet port for at least a portion of a first separated fluid component and a second outlet port for at least a portion of a second separated fluid component fluid component, side walls of the microfluidic channels are at least partially defined by projections extending from the surface of the second cover, and the second interior wall defines at least one opening providing fluid communication between at least one of the plurality of microfluidic channels and at least one of the macrofluidic channels defined by the first and second interior walls.

14. The fluid processing cassette of claim 13, wherein the first interior wall is secured to the first cover by an adhesive, the second interior wall is secured to the second cover by an adhesive, and/or the first interior wall is secured to the second interior wall by an adhesive.

15. The fluid processing cassette of claim 13, wherein the first interior wall is secured to the first cover by a weld, the second interior wall is secured to the second cover by a weld, and/or the first interior wall is secured to the second interior wall by a weld.

16. The fluid processing cassette of claim 13, wherein the second surface of the first interior wall defines one end and a sidewall of each macrofluidic channel defined between the first and second interior walls, and the first surface of the second interior wall defines a second end of each macrofluidic channel defined between the first and second interior walls.

17. The fluid processing cassette of claim 1, wherein said at least one of the microfluidic channels is configured to separate said fluid into two or more fluid components via an electric separation field.

18. The fluid processing cassette of claim 1, wherein said at least one of the microfluidic channels is configured to separate said fluid into two or more fluid components via a gravitational separation field.

19. The fluid processing cassette of claim 1, wherein said at least one of the microfluidic channels is configured to separate said fluid into two or more fluid components via a centrifugal separation field.

20. The fluid processing cassette of claim 1, wherein said at least one of the microfluidic channels is configured to separate said fluid into two or more fluid components via a magnetic separation field.

21. The fluid processing cassette of claim 1, wherein said at least one of the microfluidic channels is configured to separate said fluid into two or more fluid components via an acoustic separation field.

* * * * *